US012559807B2

(12) United States Patent
Mun et al.

(10) Patent No.: US 12,559,807 B2
(45) Date of Patent: Feb. 24, 2026

(54) DOUBLE-ORIENTED ELECTRICAL STEEL SHEET AND MANUFACTURING METHOD THEREFOR

(71) Applicant: POSCO, Pohang-si (KR)

(72) Inventors: Hyunwoo Mun, Pohang-si (KR); Se Il Lee, Pohang-si (KR)

(73) Assignee: POSCO, Pohang-si (KR)

( * ) Notice: Subject to any disclaimer, the term of this patent is extended or adjusted under 35 U.S.C. 154(b) by 763 days.

(21) Appl. No.: 17/785,240

(22) PCT Filed: Dec. 17, 2020

(86) PCT No.: PCT/KR2020/018615
§ 371 (c)(1),
(2) Date: Jun. 14, 2022

(87) PCT Pub. No.: WO2021/125861
PCT Pub. Date: Jun. 24, 2021

(65) Prior Publication Data

US 2023/0035269 A1 Feb. 2, 2023

(30) Foreign Application Priority Data

Dec. 20, 2019 (KR) ..... 10-2019-0171868

(51) Int. Cl.
*C21D 8/02* (2006.01)
*C21D 8/0221* (2026.01)
(Continued)

(52) U.S. Cl.
CPC ..... *C21D 8/0205* (2013.01); *C21D 8/0226* (2013.01); *C21D 8/0236* (2013.01); *C21D 8/0273* (2013.01); *C21D 9/46* (2013.01); *C22C 38/02* (2013.01); *C22C 38/04* (2013.01); *C22C 38/06* (2013.01); *C21D 2201/05* (2013.01)

(58) Field of Classification Search
None
See application file for complete search history.

(56) References Cited

U.S. PATENT DOCUMENTS 4,997,493 A 3/1991 Ushigami et al.
5,346,559 A 9/1994 Ushigami et al.
(Continued)

FOREIGN PATENT DOCUMENTS

BR 112019001581 B 5/2019
CN 1308143 A 8/2001
(Continued)

OTHER PUBLICATIONS

The Extended European Search Report dated May 7, 2024 issued in European Patent Application No. 20901862.1.
(Continued)

*Primary Examiner* — Xiaowei Su
(74) *Attorney, Agent, or Firm* — Morgan Lewis & Bockius LLP

(57) ABSTRACT

In a double-oriented electrical steel sheet according to an embodiment of the present invention, the fraction of crystal grains having an orientation within 15° from {100} <001> is 50 to 75%, and the fraction of crystal grains having an orientation within 15° from {100}<380> is 50 to 75%.

4 Claims, 1 Drawing Sheet

(51) Int. Cl.

| | |
|---|---|
| ***C21D 8/0247*** | (2026.01) |
| ***C21D 9/46*** | (2006.01) |
| ***C22C 38/02*** | (2006.01) |
| ***C22C 38/04*** | (2006.01) |
| ***C22C 38/06*** | (2006.01) |

(56) References Cited

U.S. PATENT DOCUMENTS

| | | | | |
|---|---|---|---|---|
| 6,562,473 | B1 * | 5/2003 | Okabe | H01F 1/14775 148/310 |
| 2017/0098498 | A1 | 4/2017 | Tada et al. | |

FOREIGN PATENT DOCUMENTS

| | | | |
|---|---|---|---|
| CN | 107217198 | A | 9/2017 |
| EP | 0906963 | A1 | 4/1999 |
| FR | 1237461 | A | 7/1960 |
| GB | 930497 | A | 7/1963 |
| GB | 1000303 | A | 8/1965 |
| JP | 2000-309859 | A | 11/2000 |
| JP | 2001-098330 | A | 4/2001 |
| JP | 2001-181738 | A | 7/2001 |
| JP | 2001-247944 | A | 9/2001 |
| JP | 2003-231922 | A | 8/2003 |
| JP | 2004-084034 | A | 3/2004 |
| JP | 2005-179745 | A | 7/2005 |
| JP | 2008-150697 | A | 7/2008 |
| JP | 2017-222910 | A | 12/2017 |
| KR | 10-2003-0054427 | A | 7/2003 |
| KR | 10-2009-0082006 | A | 7/2009 |
| KR | 10-2012-0071820 | A | 7/2012 |
| KR | 10-2017-0074635 | A | 6/2017 |
| KR | 10-1842417 | B1 | 3/2018 |
| KR | 10-1877198 | B1 | 7/2018 |
| KR | 10-2019-0034622 | A | 4/2019 |
| KR | 10-2019-0077890 | A | 7/2019 |
| KR | 10-2019-0078166 | A | 7/2019 |
| KR | 10-2009834 | B1 | 8/2019 |

OTHER PUBLICATIONS

International Search Report dated Jun. 3, 2021 issued in International Patent Application No. PCT/KR2020/018615 (with English translation).

Office Action & Search Report of corresponding Chinese Patent Application No. 202080097275.5 dated Mar. 16, 2023.

Japanese Office Action dated Sep. 26, 2023 issued in Japanese Patent Application No. 2022-537582.

* cited by examiner

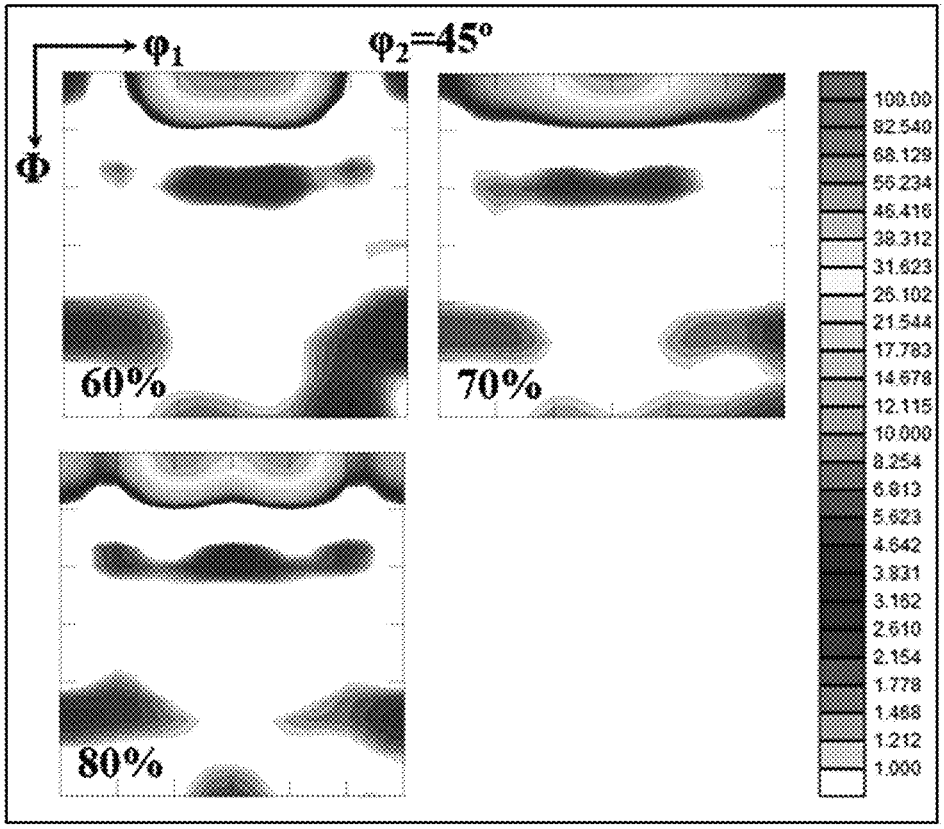
φ1
φ2=45°
Φ
60%
70%
80%
100.00
82.540
68.129
56.234
46.416
38.312
31.623
26.102
21.544
17.783
14.678
12.115
10.000
8.254
6.813
5.623
4.642
3.831
3.162
2.610
2.154
1.778
1.468
1.212
1.000

DOUBLE-ORIENTED ELECTRICAL STEEL SHEET AND MANUFACTURING METHOD THEREFOR

CROSS-REFERENCE OF RELATED APPLICATIONS

This application is the U.S. National Phase under 35 U.S.C. § 371 of International Patent Application No. PCT/KR2020/018615, filed on Dec. 17, 2020, which in turn claims the benefit of Korean Application No. 10-2019-0171868, filed on Dec. 20, 2019, the entire disclosures of which applications are incorporated by reference herein.

TECHNICAL FIELD

An exemplary embodiment of the present invention relates to a double-oriented electrical steel sheet and a manufacturing method therefor. More specifically, an exemplary embodiment of the present invention relates to a double-oriented electrical steel sheet having very excellent magnetism and a very small magnetism deviation in a rolling direction and a rolling vertical direction by adjusting a reduction ratio and final annealing time in secondary cold rolling to increase a fraction of crystal grains having a {100}<001> orientation, and a method for manufacturing the same.

BACKGROUND ART

An electrical steel sheet is divided into an oriented electrical steel sheet having excellent magnetic properties in one direction and a non-oriented electrical steel sheet having uniform magnetic properties in all directions. Considering magnetic anisotropy of BCC-structured iron, magnetic properties are controlled and changed by controlling an arrangement of atoms according to a use of a steel sheet. The oriented electrical steel sheet uses a secondary recrystallization phenomenon and has only a Goss texture of {110}<001>, but has never been commercialized in such a way that textures other than the Goss texture use the secondary recrystallization phenomenon.

Unlike the Goss orientation, a {100}<001> orientation, that is, a Cube orientation has a <001> axis, which is easy to magnetize, not only in an RD direction but also in a TD direction.

The Cube orientation has been recognized for its usefulness from the past, but only a manufacturing method through a tool that is impossible for actual large-scale industrial production, such as cross rolling or vacuum annealing, has been known.

In particular, a cross rolling method may not be utilized because continuous production of materials is impossible. In the case of a large generator, since it is necessary to manufacture a cylindrical core having a diameter of several meters, the cross rolling method may not be applied to a process of dividing a core into several to tens on a sheet surface and assembling the divided cores, and also has extremely low productivity

DISCLOSURE

Technical Problem

The present invention has been made in an effort to provide a double-oriented electrical steel sheet and a manufacturing method therefor. More specifically, the present invention has been made in an effort to provide a double-oriented electrical steel sheet having very excellent magnetism and a very small magnetism deviation in a rolling direction and a rolling vertical direction by adjusting a reduction ratio and final annealing time in secondary cold rolling to increase a fraction of crystal grains having a {100}<001> orientation, and a method for manufacturing the same.

Technical Solution

An exemplary embodiment of the present invention provides a double-oriented electrical steel sheet, in which a fraction of a crystal grain having an orientation within 15° from {100}<001> is 50 to 75%, and a fraction of a crystal grain having an orientation within 15° from {100}<380> is 50 to 75%.

A fraction of a crystal grain having an orientation within 10° from {100}<001> may be 20 to 50%, and a fraction of a crystal grain having an orientation within 10° from {100}<380> is 20 to 50%.

The double-oriented electrical steel sheet may contain, by wt %, Si: 1.0% to 7.0%, Al: 0.02% or less (exclusive of 0%), Mn: 0.02 to 0.50%, C: 0.004% or less (exclusive of 0%), and S: 0.0005 to 0.005%, and the balance of Fe and other inevitable impurities.

An average grain diameter of the crystal grain may be 2000 μm or more.

A deviation of a magnetic flux density (B50) in a rolling direction (L direction) and a magnetic flux density (B50) in the rolling vertical direction (C direction) defined by the following formula 1 may be 3 or less.

$$\frac{|B_{50}^{L} - B_{50}^{C}|}{\mathrm{MAX}(B_{50}^{L}, B_{50}^{C})} \times 100 \quad \text{[Equation 1]}$$

(In Equation 1, $B^{L}_{50}$ and $B^{C}_{50}$ denote the magnetic flux densities (B50) in the rolling direction and the rolling vertical direction, respectively, and MAX $B^{L}_{50}$ and $B^{C}_{50}$ denote the larger value of the magnetic flux densities (B50) in the rolling direction and the rolling vertical direction)

Another embodiment of the present invention provides a method for manufacturing a double-oriented electrical steel sheet, including: manufacturing a hot-rolled sheet by hot-rolling a slab; manufacturing a primary cold-rolled sheet by primarily cold-rolling the hot-rolled sheet; intermediate annealing the primary cold-rolled sheet; manufacturing a secondary cold-rolled sheet by secondary cold-rolling an intermediate annealed sheet; and final annealing the secondary cold-rolled sheet.

In the manufacturing of the secondary cold-rolled sheet, a reduction ratio may be 55 to 85%.

In the final annealing, the annealing may be performed for 6 to 60 hours.

The slab may contain, by wt %, Si: 1.0% to 7.0%, Al: 0.02% or less (exclusive of 0%), Mn: 0.02 to 0.50%, C: 0.004% or less (exclusive of 0%), and S: 0.0005 to 0.005%, and the balance of Fe and other inevitable impurities.

The method may further include annealing the hot-rolled sheet after the manufacturing of the hot-rolled sheet.

The manufacturing of the primary cold-rolled sheet may include one time cold rolling or two times or more cold rolling with intermediate annealing interposed therebetween.

In the manufacturing of the first cold-rolled sheet and the manufacturing of the secondary cold-rolled sheet, the rolling may be performed in the same direction.

In the intermediate annealing, the annealing may be performed in a reducing atmosphere.

The method may further include applying an annealing separator after the manufacturing of the secondary cold-rolled sheet.

In the final annealing, the annealing may be performed in a reducing atmosphere.

In the final annealing, the annealing may be performed at a temperature of 1000 to 1200° C.

Advantageous Effects

According to an embodiment of the present invention, a double-oriented electrical steel sheet has similar magnetic values in a rolling direction and a rolling vertical direction regardless of the directions, and exhibits excellent magnetic properties such as high magnetic flux density and low iron loss.

DESCRIPTION OF THE DRAWINGS

FIG. 1 is an ODF analysis result of Examples 1 to 3 in Experimental Example 1.

MODE FOR INVENTION

The terms first, second, third, and the like are used to describe, but are not limited to, various parts, components, areas, layers and/or sections. These terms are used only to distinguish a part, component, region, layer, or section from other parts, components, regions, layers, or sections. Accordingly, a first part, a component, an area, a layer, or a section described below may be referred to as a second part, a component, a region, a layer, or a section without departing from the scope of the present disclosure.

Terminologies used herein are to mention only a specific exemplary embodiment, and do not to limit the present invention. Singular forms used herein include plural forms as long as phrases do not clearly indicate an opposite meaning. The meaning "including" used in the present specification concretely indicates specific properties, areas, integer numbers, steps, operations, elements, and/or components, and is not to exclude presence or addition of other specific properties, areas, integer numbers, steps, operations, elements, and/or components thereof.

When a part is referred to as being "above" or "on" other parts, it may be directly above or on other parts, or other parts may be included in between. In contrast, when a part is referred to as being "directly above" another part, no other part is involved in between.

All terms including technical terms and scientific terms used herein have the same meaning as the meaning generally understood by those skilled in the art to which the present invention pertains unless defined otherwise. All terms including technical terms and scientific terms used herein have the same meaning as the meaning generally understood by those skilled in the art to which the present invention pertains unless defined otherwise.

In addition, unless otherwise specified, % means wt %, and 1 ppm is 0.0001 wt %.

In an embodiment of the present invention, further including additional elements means that the balance of iron (Fe) is replaced and included as much as the additional amount of the additional elements.

Hereinafter, an exemplary embodiment of the present invention will be described in detail so that a person of ordinary skill in the art to which the present invention pertains can easily implement the present invention. As those skilled in the art would realize, the described embodiments may be modified in various different ways, all without departing from the spirit or scope of the present invention.

An exemplary embodiment of the present invention provides a double-oriented electrical steel sheet, in which a fraction of crystal grains having an orientation within 15° from {100}<001> is 50 to 75%, and a fraction of crystal grains having an orientation within 15° from {100}<380> is 50 to 75%.

A crystal grain having an orientation within 15° from the above-described {100}<001> is also called a Cube orientation crystal grain. According an exemplary embodiment of the present invention, there may be provided a double-oriented electrical steel sheet having very excellent magnetism in a rolling direction and a rolling vertical direction, and having a very small magnetic deviation by including an area fraction of Cube orientation crystal grains to 50 to 75%, and at the same time, including an area fraction of crystal grains having an orientation within 15° from {100}<380> to 50 to 75%. The {100} <001> direction and the {100}<380> direction overlap within 15°, and in an exemplary embodiment of the present invention, crystal grains having an orientation within 15° from {100}<001> and crystal grains simultaneously corresponding to crystal grains having an orientation within 15° from {100}<380> are calculated in duplicate, respectively. Accordingly, the sum of the fractions of crystal grains having an orientation within 15° from {100}<001> and crystal grains having an orientation within 15° from {100}<380> may exceed 100%.

More specifically, a fraction of crystal grains having an orientation within 15° from {100}<001> is 50 to 65%, and a fraction of crystal grains having an orientation within 15° from {100}<380> is 55 to 75%. More specifically, a fraction of crystal grains having an orientation within 15° from {100}<001> is 60 to 65%, and a fraction of crystal grains having an orientation within 15° from {100}<380> is 55 to 60%.

The fractions of crystal grains may be evaluated as an area fraction for a specific plane. In this case, the area fraction may be an area fraction of crystal grains measured based on a plane parallel to a rolling plane (plane perpendicular to an ND direction).

In the double-oriented electrical steel sheet according to an exemplary embodiment of the present invention, a fraction of a crystal grain having an orientation within 10° from {100}<001> may be 20 to 50%, and a fraction of a crystal grain having an orientation within 10° from {100}<380> is 20 to 50%.

More specifically, a fraction of crystal grains having an orientation within 10° from {100}<001> is 25 to 45%, and a fraction of crystal grains having an orientation within 10° from {100}<380> is 20 to 45%. More specifically, a fraction of crystal grains having an orientation within 10° from {100}<001> is 40 to 45%, and a fraction of crystal grains having an orientation within 10° from {100}<380> is 30 to 35%. The sum of the fractions of crystal grains having an orientation within 10° from {100}<001> and crystal grains having an orientation within 10° from {100}<380> may be less than 100%, and the remainder is crystal grains having an orientation outside the above-described orientation range.

The double-oriented electrical steel sheet may contain, by wt %, Si: 1.0% to 7.0%, Al: 0.02% or less (exclusive of 0%), Mn: 0.02 to 0.50%, C: 0.004% or less (exclusive of 0%), and S: 0.0005 to 0.005%, and the balance of Fe and other inevitable impurities.

The reason for limiting the compositions of the double-oriented electrical steel sheet will be described first.

Si: 1.0 to 7.0 wt %

Silicon (Si) is an element that forms austenite in hot rolling. In the vicinity of the slab heating temperature and the hot-rolled sheet annealing temperature, it is necessary to limit the addition amount in order to have an austenite fraction of about 10 vol %. In addition, in the final annealing, it is necessary to limit the composition to a ferrite single phase because the formation of a recrystallization microstructure may occur smoothly during annealing only when the ferrite single phase is used in the final annealing. In pure iron, when 1.0 wt % or more is added, the ferrite single phase is formed, and since the austenite fraction may be adjusted through the addition of C, the lower limit of the Si content may be limited to 1.0 wt %. In addition, when the Si content exceeds 7.0 wt %, the cold rolling is difficult, and the saturation magnetic flux is lowered, so the Si content is limited. More specifically, Si may be contained in an amount of 2.0 to 4.0 wt % More specifically, in order to obtain a steel sheet having a high magnetic flux density, Si may be contained in an amount of 2.5 to 3.5 wt %.

Al: 0.02 wt % or Less

Aluminum (Al) may serve to increase Al resistivity. However, $Al_2O_3$ is formed on a surface of a steel sheet during heat treatment of a steel sheet to which a large amount of Al is added. $Al_2O_3$ may penetrate into a crystal grain boundary from the surface, which inhibits the growth of crystal grains and becomes a factor hindering secondary recrystallization. Therefore, the Al content is preferably 0.02 wt % or less. More specifically, Al may be contained in an amount of 0.01 wt % or less. More specifically, Al may be contained in an amount of 0.005 wt % or less.

Mn: 0.02 to 0.50 wt %

Manganese (Mn) is an element that increases resistivity. However, when the addition of Mn is excessive, there is a possibility of passing the austenite region during heat treatment, and causing a phase transformation. In addition, an excessive amount of Mn traps sulfur more than necessary, thereby preventing the diffusion of element S. An appropriate amount of Mn precipitates fine MnS to hold the crystal grain boundary with weak force, and MnS melts away at an appropriate temperature, and secondary recrystallization occurs. Since a speed of volatilized S may be controlled to some extent with Mn, it can be seen that the addition of an appropriate amount of Mn plays a certain role in secondary recrystallization. More specifically, Mn may be contained in amount of 0.05 to 0.30 wt %.

C: 0.004 wt % or Less

Unlike other elements described above, carbon (C) is not substituted with Fe atoms and is an element that penetrates into an interstitial site. Due to its properties, when C is added in a large amount, the movement of dislocations is inhibited and the growth of crystal grains is hindered. More specifically, C may be contained in an amount of 0.003 wt % or less.

S: 0.0005 to 0.0050 wt %

The surface energy of sulfur (S) is changed depending on the content of S segregated on the surface, and the recrystallization phenomenon of crystal grains of a specific orientation may occur due to the changed surface energy. A {110} plane is stable on the surface without S at all, a {100} plane is stable on the surface where S is weakly segregated, and a {111} plane is stable on the surface with a large amount of S segregation. To slightly segregate S on the surface, the S content is adjusted to a very small amount. Mn also acts as an additional trap for S, helping to weakly segregate S on the surface. More specifically, S may be contained in an amount of 0.0010 to 0.0040 wt %.

In addition, in the double-oriented electrical steel sheet of the present invention, the balance other than the above-described components is Fe and inevitable impurities. However, it does not exclude containing other elements as long as they are in the range which does not impair the effect of the present invention.

The double-oriented electrical steel sheet according to an exemplary embodiment of the present invention may have an average crystal grain diameter of 2000 μm or more. When the average crystal grains diameter is too small, the fractions of {100}<001> and {100}<380> textures may be lowered, resulting in lowering magnetism. The crystal grains diameter may be measured based on the plane parallel to the rolling plane (ND plane) of the steel sheet Assuming an imaginary circle having the same area as the crystal grains, the particle size means the diameter of the circle. More specifically, the average crystal grains diameter may be 2500 μm or more.

The double-oriented electrical steel sheet according to an exemplary embodiment of the present invention has excellent magnetism in both the rolling direction and the rolling vertical direction. Specifically, $B_8$ both in the rolling direction and the rolling vertical direction may be 1.65T or more. More specifically, $B_8$ both in the rolling direction and the rolling vertical direction may be 1.70T or more. More specifically, $B_8$ both in the rolling direction and the rolling vertical direction may be 1.73T or more.

The double-oriented electrical steel sheet according to an exemplary embodiment of the present invention has excellent magnetism in both the rolling direction and the rolling vertical direction. Specifically, $B_{50}$ both in the rolling direction and the rolling vertical direction may be 1.80T or more. More specifically, $B_8$ both in the rolling direction and the rolling vertical direction may be 1.85T or more. More specifically, $B_8$ both in the rolling direction and the rolling vertical direction may be 1.88T or more.

A deviation of a magnetic flux density (B50) in a rolling direction (L direction) and a magnetic flux density (B50) in the rolling vertical direction (C direction) defined by the following formula 1 may be 3 or less.

$$\frac{|B_{50}^{L} - B_{50}^{C}|}{\mathrm{MAX}(B_{50}^{L}, B_{50}^{C})} \times 100 \quad \text{[Equation 1]}$$

(In Equation 1, $B^{L}_{50}$ and $B^{C}_{50}$ denote the magnetic flux densities ($B_{50}$) in the rolling direction and the rolling vertical direction, respectively, and MAX $B^{L}_{50}$ and $B^{C}_{50}$ denote the larger value of the magnetic flux densities (B50) in the rolling direction and the rolling vertical direction)

More specifically, the deviation may be 2 or less.

Another embodiment of the present invention provides a method for manufacturing a double-oriented electrical steel sheet, including: manufacturing a hot-rolled sheet by hot-rolling a slab; manufacturing a primary cold-rolled sheet by primarily cold-rolling the hot-rolled sheet; intermediate annealing the primary cold-rolled sheet; manufacturing a secondary cold-rolled sheet by secondary cold-rolling an intermediate annealed sheet; and final annealing the secondary cold-rolled sheet.

Hereinafter, each step will be described in detail.

First, a slab is manufactured. The reason for limiting the addition ratio of each composition in the slab is the same as the reason for limiting the composition of the above-described double-oriented electrical steel sheet, and thus, repeated description will be omitted. In the manufacturing process of hot rolling, hot-rolled sheet annealing, primary cold rolling, intermediate annealing, secondary cold rolling, final annealing, and the like, which will be described later, the element content does not substantially change, so the composition of the slab and the composition of the double-oriented electrical steel are substantially the same.

The slab may be manufactured using a thin slab method or a strip casting method. The thickness of the slab may be 200 to 300 mm. The slab may be heated as needed. The heating temperature may be 1100 to 1250° C., and the heating time may be 30 minutes or more.

Next, the slab is hot-rolled to manufacture the hot-rolled steel sheet.

In the manufacturing of the hot-rolled sheet, the thickness of the hot-rolled sheet may be 2.0 to 3.0 mm.

The method may further include annealing the hot-rolled sheet after the manufacturing of the hot-rolled sheet. In the annealing of the hot-rolled sheet, the annealing may be performed at a temperature of 1000 to 1150° C. In addition, the annealing may be performed for 60 to 150 seconds. The method may further include pickling after the annealing of the hot-rolled sheet.

Next, a primary cold-rolled sheet is manufactured by primarily rolling the hot-rolled sheet.

The manufacturing of the primary cold-rolled sheet may include one time cold rolling or two times or more cold rolling with intermediate annealing interposed therebetween.

In the manufacturing of the primary cold-rolled sheet and the manufacturing of the secondary cold-rolled sheet, the rolling may be performed in the same direction.

Next, the primary cold-rolled sheet is subjected to intermediate annealing.

Since the intermediate annealing is sufficient to complete recrystallization, the annealing may be performed at 900 to 1100° C. for 60 to 150 seconds.

In the intermediate annealing, the annealing may be performed in a reducing atmosphere. Since the secondary cold rolling should be performed after the intermediate annealing, the annealing may be performed in an atmosphere with a large amount of hydrogen so as not to be oxidized during the annealing. The remaining atmosphere may be air.

Next, the intermediate annealed sheet is subjected to secondary cold rolling to prepare a secondary cold-rolled sheet.

The secondary cold rolling may adjust a reduction ratio to 55 to 85%. When the reduction ratio is too small, fewer crystal grains of {100}<001> and {100}<380> orientations may be formed. When the reduction ratio is too high, the <001> direction of the crystal grains rotates after recrystallization, and secondary recrystallization occurs in a direction such as <250> or <120>, which rotates more than <380>. More specifically, the reduction ratio may be 55 to 80%. More specifically, the reduction ratio may be 55 to 65%.

The reduction ratio may be calculated as ([thickness of steel sheet before reduction]−[thickness of steel sheet after reduction])/[thickness of steel sheet before reduction].

After the secondary cold rolling, an annealing separator may be applied for long-time annealing. The annealing separator may include alumina ($Al_2O_3$).

Next, the secondary cold-rolled sheet is final annealed.

In the final annealing, the annealing may be performed for 6 to 60 hours. When the annealing time is too short, the crystal grains of {100}<001> and {100}<380> orientations may not be properly formed. When the annealing time is too long, energy waste may occur. More specifically, the final annealing may be annealed for 12 to 48 hours.

In the final annealing, the annealing may be performed in a reducing atmosphere.

In the final annealing, the annealing may be performed at a temperature of 1000 to 1200° C. When the annealing temperature is too low, the recrystallization may not occur properly. Even if the annealing temperature is higher, it is difficult to improve the magnetism.

The following examples illustrate the present invention in more detail. However, the following Examples are only exemplary embodiments of the present disclosure, and the present invention is not limited to the following Examples.

Example 1

A slab composed of components shown in Table 1 and the balance of Fe and inevitable impurities was prepared, heated at 1130° C. for 2 hours, and then hot rolled to 2.5 mm. The hot-rolled sheet was heat-treated at 1070° C. for 2 minutes, and was primarily subjected to cold rolling after pickling. The experiment was conducted under the condition that the final thickness is fixed at 0.2 mm, and the reduction ratio of the secondary cold rolling changes from 40% to 80%. Therefore, the final thickness during the primary cold rolling was 2 mm (90%), 1 mm (80%), 0.67 mm (70%), 0.50 mm (60%), and 0.33 mm (40%), respectively, and the specimen subjected to the first rolling was heat-treated at 1050° C. for about 2 minutes. In this case, the heat treatment was carried out in an atmosphere of 100% hydrogen. The specimen was subjected to the secondary cold rolling and finally fitted to a thickness of 0.2 mm. Each specimen was cut into a size of 60×60 mm to measure magnetism with a single sheet tester (SST), and the size-fitted specimens were heat-treated in a hydrogen atmosphere in a heating furnace set to 1100° C. for 48 hours.

In Table 1, the area fraction and grain size of crystal grains having {100} <001> and {100}<380> orientations were measured and summarized. The ODF results were shown in FIG. 1. It can be seen that a large number of crystal grains having {100} <001> and {100}<380> orientations are formed when the secondary cold rolling reduction ratio is 60 to 80%. It can be seen that in addition to the 50% of {100}<001> and {100}<380> orientations, other orientations with the {001} plane are widely spread.

In addition, B8 and B50 were measured and summarized in Table 2.

TABLE 1

| | Si(wt %) | Mn(wt %) | S(wt %) | Secondary cold rolling reduction ratio (%) | Fraction within {100} < 001 > 15° (%) | Fraction within {100} < 380 > 15° (%) | Fraction within {100} < 001 > 10° (%) | Fraction within {100} < 380 > 10° (%) |
|---|---|---|---|---|---|---|---|---|
| Comparative Example 1 | 3 | 0.1 | 0.003 | 40 | 42 | 11 | 40 | 25 |
| Example 1 | 3 | 0.1 | 0.003 | 60 | 64 | 57 | 41 | 34 |
| Example 2 | 3 | 0.1 | 0.003 | 70 | 51 | 56 | 27 | 22 |
| Example 3 | 3 | 0.1 | 0.003 | 80 | 56 | 72 | 32 | 43 |
| Comparative Example 2 | 3 | 0.1 | 0.003 | 90 | 13 | 94 | 0 | 90 |

TABLE 2

| | B8 average (T) | Rolling direction B8 (T) | Rolling vertical direction B8 (T) | B50 average (T) | Rolling direction B50 (T) | Rolling vertical direction B50 (T) | B50 deviation |
|---|---|---|---|---|---|---|---|
| Comparative Example 1 | 1.64 | 1.62 | 1.65 | 1.79 | 1.78 | 1.81 | 1.70 |
| Example 1 | 1.78 | 1.79 | 1.76 | 1.92 | 1.94 | 1.90 | 2.06 |
| Example 2 | 1.69 | 1.73 | 1.65 | 1.87 | 1.90 | 1.84 | 3.16 |
| Example 3 | 1.70 | 1.69 | 1.71 | 1.87 | 1.86 | 1.89 | 1.59 |
| Comparative Example 2 | 1.64 | 1.63 | 1.65 | 1.82 | 1.82 | 1.83 | 3.18 |

As illustrated in Tables 1 and 2, it can be seen that in Examples 1 to 3, a large number of crystal grains having {100} <001> and {100}<380> orientations are formed.

On the other hand, Comparative Example 1 has a low reduction ratio, so that it can be seen that relatively few crystal grains having {100} <001> and {100}<380> orientations are formed, and the magnetism is relatively poor.

In addition, Comparative Example 2 has a high reduction ratio, so that it can be seen that relatively few crystal grains having {100}<001> and {100}<380> orientations are formed, and the magnetism is relatively poor.

The present invention is not limited to the exemplary embodiments, but may be manufactured in a variety of different forms, and the present invention may be manufactured in a variety of different forms, and those of ordinary skill in the art to which the present invention pertains will understand that the present invention may be implemented in other specific forms without changing the technical spirit or essential features of the present invention. Therefore, it should be understood that the above-mentioned exemplary embodiments are exemplary in all aspects but are not limited thereto.

The invention claimed is:

1. A double-oriented electrical steel sheet, comprising, by wt %:

Si: 1.0% to 7.0%,

Al: 0.02% or less (exclusive of 0%),

Mn: 0.02 to 0.50%,

C: 0.004% or less (exclusive of 0%),

S: 0.0005 to 0.005%, and the balance of Fe and other inevitable impurities, wherein a fraction of a crystal grain having an orientation within 15° from {100}<001> is 50 to 75%, and a fraction of a crystal grain having an orientation within 15° from {100}<380> is 50 to 75%.

2. The double-oriented electrical steel sheet of claim 1, wherein:

a fraction of a crystal grain having an orientation within 10° from {100}<001 > is 20 to 50%, and a fraction of a crystal grain having an orientation within 10° from {100}<380> is 20 to 50%.

3. The double-oriented electrical steel sheet of claim 1, wherein:

an average grain diameter of the crystal grain is 2000 μm or more.

4. The double-oriented electrical steel sheet of claim 1, wherein:

a deviation of a magnetic flux density (B50) in a rolling direction (L direction) and a magnetic flux density (B50) in the rolling vertical direction (C direction) defined by the following formula 1 is 3 or less:

$$\frac{\left|B_{50}^{L} - B_{50}^{C}\right|}{\mathrm{MAX}\left(B_{50}^{L}, B_{50}^{C}\right)} \times 100 \quad \text{[Equation 1]}$$

(In Equation 1, $B^{L}_{50}$ and $B^{C}_{50}$ denote the magnetic flux densities (B50) in the rolling direction and the rolling vertical direction, respectively, and MAX $B^{L}_{50}$ and $B^{C}_{50}$ denote the larger value of the magnetic flux densities (B50) in the rolling direction and the rolling vertical direction).

* * * * *